United States Patent [19]

Kuroda et al.

[11] Patent Number: 4,901,553

[45] Date of Patent: Feb. 20, 1990

[54] METHOD OF MANUFACTURING A FINNED TUBE

[75] Inventors: Kouichi Kuroda; Chihiro Hayashi; Kazuyuki Nakasuji, all of Amagasaki, Japan

[73] Assignee: Sumitomo Metal Industries, Ltd., Osaka, Japan

[21] Appl. No.: 201,466

[22] Filed: Jun. 2, 1988

[30] Foreign Application Priority Data

Jun. 3, 1987 [JP] Japan ..... 62-139380
Oct. 20, 1987 [JP] Japan ..... 62-266029

[51] Int. Cl.[4] ..... B21D 53/06
[52] U.S. Cl. ..... 72/97; 72/98
[58] Field of Search ..... 72/68, 96, 97, 98, 78; 29/157.3 A, 157.3 AH

[56] References Cited

U.S. PATENT DOCUMENTS

| | | | |
|---|---|---|---|
| 1,865,575 | 7/1932 | Locke | 72/97 |
| 2,005,155 | 6/1935 | Moise | 72/97 |
| 2,017,388 | 10/1935 | Bannister | 72/97 |
| 3,648,502 | 3/1972 | Klug et al. | 72/98 |
| 3,683,656 | 8/1972 | Lewis | 72/98 |
| 3,745,801 | 7/1973 | Kallfelz et al. | 72/98 |
| 4,153,982 | 5/1979 | Przybyla et al. | 72/98 |

*Primary Examiner*—Lowell A. Larson
*Attorney, Agent, or Firm*—Burns, Doane, Swecker & Mathis

[57] ABSTRACT

A method of manufacturing a metallic tube with a spiral fin for use as a heat transfer tube of a heat exchanger and the like. A solid metallic bar or metallic elementary hollow bar provided with a small hole is supplied to an inclined rolling mill having a plurality of rolls provided with a plurality of annular grooves formed on an outer circumferential surface thereof, and the solid metallic bar or metallic elementary hollow bar is worked into a pierced hollow bar by piercing rolling by means of a piercing plug and at the same time a fin is formed on an outer circumferential surface of the pierced hollow bar to integrate the fin with a body of the tube. Accordingly, the piercing rolling and the formation of the fin on the outer circumferential surface of the tube can be carried out at the same time, so that the manufacturing process can be remarkably shortened and the productivity can be high. In addition, a high fin can be formed and the shape of the fin becomes reliable, whereby the product can be remarkably improved in quality.

13 Claims, 13 Drawing Sheets

METHOD OF MANUFACTURING A FINNED TUBE

BACKGROUND OF THE INVENTION

1. Field of the Invention

The present invention relates to a method of manufacturing a metallic tube with spiral fin, used as for example a heat transfer tube of a heat exchanger and the like, in particular to a method of manufacturing a metallic tube with spiral fin directly from a solid metallic bar or a metallic elementary hollow bar by the use of a piercing mill of inclined type.

2. Description of the Prior Art

A metallic tube with spiral fin has been used as a heat transfer tube of a heat exchanger and the like and various methods of manufacturing such a metallic tube with spiral fin have been proposed. The main methods include a first method, in which a spiral fin is spirally fixed to an outer circumference of a metallic tube by welding (Japanese Patent Application Laid-Open No. 9715/1983), a second method, in which a fin is spirally formed on an outer circumference of a metallic tube by thread rolling (JOURNAL OF THE JAPAN SOCIETY FOR TECHNOLOGY OF PLASTICITY, Vol. 10, No. 105, 1969-10, pp 731–732) and the like.

The first method is, as shown in FIG. 1 (perspective view), a method, in which a belt-like plate material 32 is continuously supplied, so that one edge thereof may be engaged with an outer circumferential surface of a cylindrical metallic tube 31 transferred in a longitudinal direction while rotating around an axis thereof, to spirally wind said belt-like plate material 32 on the outer circumferential surface and a joining portion of the metallic tube 31 and the belt-like plate material 32 is subjected to the high-frequency welding.

In the case where a metallic tube with spiral fin is manufactured by such a method, various disadvantages have occurred in that for example a great driving force is required for winding the belt-like plate material 32 around the outer circumferential surface of the cylindrical metallic tube; increasing a speed of winding the belt-like plate material is difficult; a tensile stress is apt to generate on the outer circumferential side of the belt-like plate material 32 wound around the metallic tube 31 and cause cracking while a compression stress is apt to generate on an inner circumferential side of the belt-like plate material 32 wound around the metallic tube 31 and produce folds, plaits and waving; complete welding of the joining portion of the metallic tube 31 and the belt-like plate material 32 is difficult; in the case where the obtained metallic tube with spiral fin is used as a heat transfer tube, any incomplete welding of the joining portion leads to inferior heat transfer characteristics; and portions, which are incompletely welded, are separated after a long-term use as boiler tubes and the like.

On the other hand, the second method is, as shown in FIG. 2 (front view) and FIG. 3 (sectional view of FIG. 2 taken along the line III—III thereof), a method, in which an elementary tube $T_O$ with a mandrel inserted therethrough is subjected to cold (or hot) thread rolling by means of three thread rolls 41, 42 and 43 disposed around a pass line of the elementary tube $T_O$. The rolls 41, 42 and 43 are the same in shape and consist of several tens of disk rolls, which are thinwalled disks and have a sectional shape of an outer circumferential portion thereof thinned in the form of a wedge, an almost U-letter shaped groove being formed on an outer surface of the elementary tube $T_O$ by a rolling pressure in the direction of wall-thickness, the groove being rolled by the following disk roll with increasing the depth by a force acting in a direction meeting at right angles with a surface of the groove, and an amount of metal pushed aside by the plastic working of the groove being deformed in a gap between the disk rolls of the above described rolls to form a fin 44. The elongation of the tube in an axial direction thereof hardly occurs during this process and also an inside diameter of the tube being maintained at almost the same level as that of the elementary tube until the process is over.

However, in the above described second method, materials of a heat transfer tube, which can be manufactured, are limited to soft metals, remarkably superior in workability, such as Al and Cu. It is difficult to form a spiral fin made of high-alloy steel, stainless steel and standard steel and the application of this method is limited to the rolling under the condition that the elongation of the tube itself is hardly produced.

In order to eliminate the above described disadvantages, the present inventors have proposed a third method, in which a roll comprises annular grooves formed on an outer circumferential surface thereof so that their intervals may be gradually widened toward an outlet side from an inlet side of materials, a mandrel bar being inserted into an elementary tube, and the elementary tube with the mandrel bar inserted thereinto being rolled in an elongated manner by means of a rolling mill of inclined type to obtain spiral fin by thread rolling (Japanese Patent Appln. Laid-Open No. 124023/1987).

That is to say, as shown in FIG. 4 (front view) and FIG. 5 (enlarged side view showing a section of FIG. 4 taken along the line V—V thereof), a cross-type inclined rolling mill provided with three (or four) rolls 61, 62, 63 disposed around a pass line, a plurality of annular grooves for forming a spiral fin is formed in a circumferential direction of the outer circumferential surface thereof so that their intervals may be gradually increased toward the outlet side from the inlet side of a metallic tube, is used, a hot hollow metallic elementary tube $T_O$ being supplied among said rolls 61, 62, 63 with inserting a mandrel 66 into the hollow portion to carry out the inclined rolling of said metallic elementary tube $T_O$, thereby forming a spiral fin.

According to such third method, the spiral fin can be formed on an outer circumferential surface of also the metallic elementary tube made of standard steel, stainless steel and the like.

However, in the case where a metallic tube with spiral fin is manufactured according to the above described third method, material of the metallic elementary tube pushed aside by rolls flows mainly in the axial direction of the metallic elementary tube and the metallic elementary tube is elongated in the axial direction thereof while forming a fin during the process of deforming the metallic elementary tube.

Accordingly, a problem has occurred in that in the case where a metallic tube with spiral fin having a high fin (hereinafter referred to as high-fin tube) requiring the flow of a material thereof in a radial direction thereof is manufactured, the above described method can not be effectively used.

Incidentally, in the case where a high fin tube made of standard steel and stainless steel having a ductility at hot rolling temperatures which is lower than that of soft metals, such as Cu and Al, is manufactured by the above described method, it is required to use a hollow metallic elementary tube having an outside diameter corresponding to an outside diameter of the fin and an inside diameter slightly larger than that of the product. Consequently, it is necessary to use a thick-walled tube having a wall-thickness to outside diameter ratio exceeding for example 30%. In the case where the above described method is practiced using such a metallic elementary tube having a large outside diameter, an energy required for the plastic working in the inclined rolling is increased and at present a thick-walled tube having a wall-thickness to outside diameter ratio exceeding 30% can not be manufactured into a seamless tube at any existing mandrel mill plant, so that for example a hole must be pierced by mechanical working in using a drill, for which a large amount of time is required, being required for the internal drilling of the metallic elementary tube, yield o the material being reduced, and the like, and as a result, the cost of production is remarkably increased. Accordingly, the above described method has not been applied but usually the conventional first method shown in FIG. 1 has been applied.

A metallic tube with spiral fin, in which the fin does not stand vertically relatively to an axis of tube, has been known. Since two pieces of such a metallic tube with spiral fin (hereinafter referred to as screw tube) disposed in parallel are rotated to crush solid substances put between the fins according to various circumstances, such a metallic tube with fin can be used for garbage disposal facilities, the crushing of scraps, soils and sands and the like.

In the case where the screw tube is manufactured by the first method, a metallic plate for the fin is welded while it is obliquely pressed against the tube. But, since the metallic plate is pressed against the tube and welded to the tube at the same time, as understood from FIG. 1, the metallic plate is bent or the welded portion can not be satisfactorily fixed, as above described. Furthermore, since the metallic plate is obliquely welded, difficult points have occurred in that it is difficult to position the metallic plate and both sides of the metallic plate are different in strain, so that bending or cracking is still more easily produced which remarkably reduces the production speed of the screw tube.

SUMMARY OF THE INVENTION

The present invention has been achieved on the basis of the above described matters. According to a method of manufacturing a metallic tube with spiral fin of the present invention, the piercing rolling and the formation of the fin are carried out at the same time by subjecting a solid metallic bar or a metallic elementary hollow bar to the piercing rolling using a plurality of rolls provided with a plurality of annular grooves formed on an outer circumferential surface thereof and a piercing plug to manufacture the metallic tube with spiral fin.

Thus, it is a first object of the present invention to provide a method of manufacturing a metallic tube with spiral fin wherein the metallic tube with spiral fin is provided with a high fin (high-fin tube) in which the fin is formed integrally with a tube body.

It is a second object of the present invention to provide a method of manufacturing a metallic tube with spiral fin capable of remarkable shortening the manufacturing process.

It is a third object of the present invention to provide a method of manufacturing a metallic tube with spiral fin having a high productivity.

It is a fourth object of the present invention to provide a method of manufacturing a metallic tube with spiral fin capable of remarkably reducing the cost of production.

It is a fifth object of the present invention to provide a method of manufacturing a metallic tube with spiral fin capable of uniformly and surely forming of the spiral fin and remarkably improving the quality of the product.

It is a sixth object of the present invention to provide a method of manufacturing a metallic tube with spiral fin in which it is unnecessary to provide guide shoes by using an inclined rolling mill consisting of three or four rolls.

It is a seventh object of the present invention to provide a method of manufacturing a metallic tube with spiral fin capable of increasing the rolling speed and improving productivity by using an inclined rolling mill consisting of two rolls and guide shoes.

It is an eighth object of the present invention to provide a method of manufacturing a metallic tube with spiral fin capable of increasing production speed and improving productivity by forming a plurality of fins at the same time and in parallel relationship.

It is a ninth object of the present invention to provide a method of manufacturing a metallic tube with spiral fin wherein the metallic tube (screw tube) has an inclined spiral fin of good quality by inclining a direction of depth of grooves on each outlet side of rolls by an appointed angle relative to an axis of the tube.

It is a tenth object of the present invention to provide a method of manufacturing a metallic tube with spiral fin capable of making the manufacturing process easy by using a metallic elementary hollow bar provided with a small hole as a material to be rolled.

The above and further objects and features of the invention will more fully be apparent from the following detailed description with accompanying drawings.

DESCRIPTION OF THE PREFERRED EMBODIMENTS

The preferred embodiments of the present invention will now be concretely described. Initially, a first preferred embodiment of the method of manufacturing a metallic tube with spiral fin according to the present invention, in which a solid metallic bar is subjected to piercing rolling using three rolls to form a metallic tube with a single spiral fin vertical to a pass line, is described.

Figure 1:
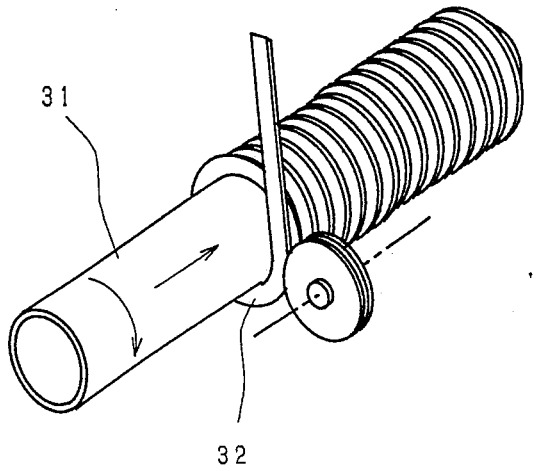
Fig. 1 Prior Art
FIG. 1 is a perspective view showing the first method of manufacturing the conventional metallic tube with spiral fin.
Figure 2:
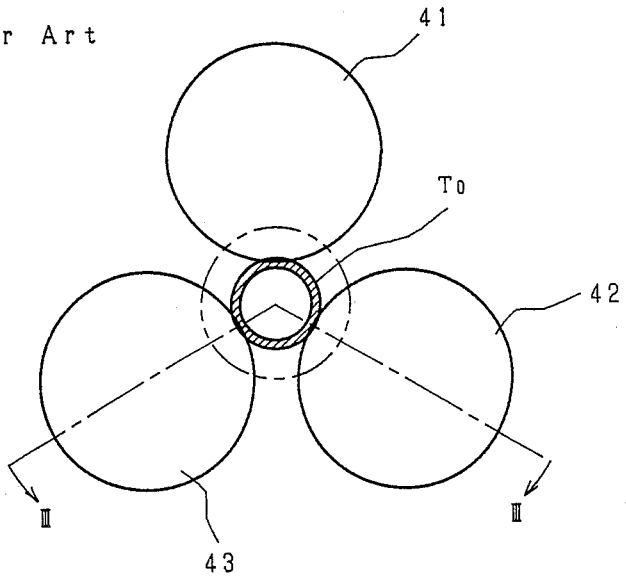
Fig. 2 Prior Art
FIG. 2 is a front view showing the second method of manufacturing the conventional metallic tube with spiral fin.
Figure 3:
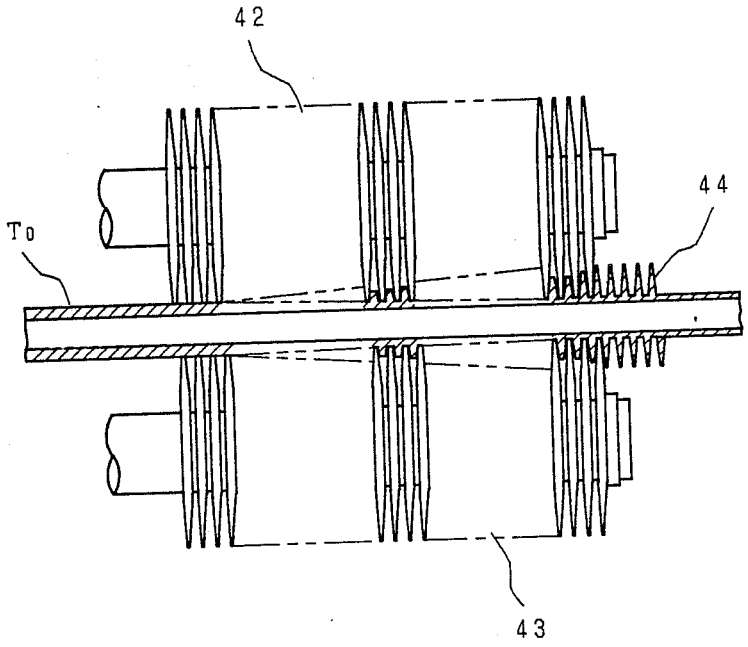
Fig. 3 Prior Art
FIG. 3 is an enlarged sectional view of FIG. 2 taken along the line III—III thereof.
Figure 4:
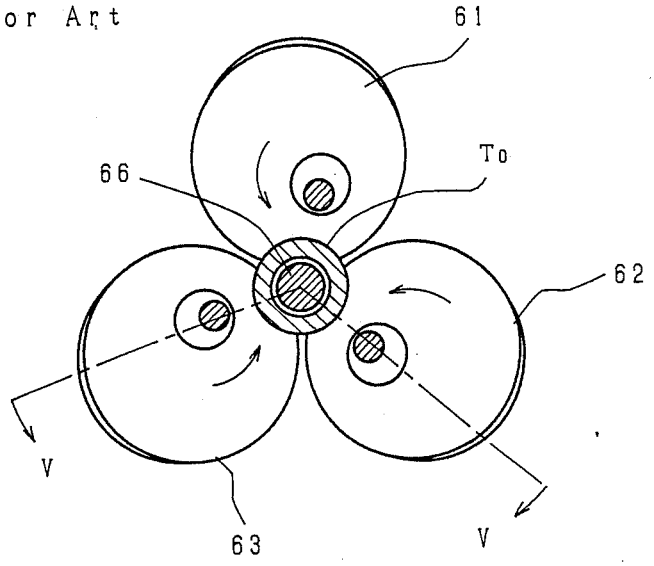
Fig. 4 Prior Art
FIG. 4 is a front view showing the third method of manufacturing the conventional metallic tube with spiral fin.
Figure 5:
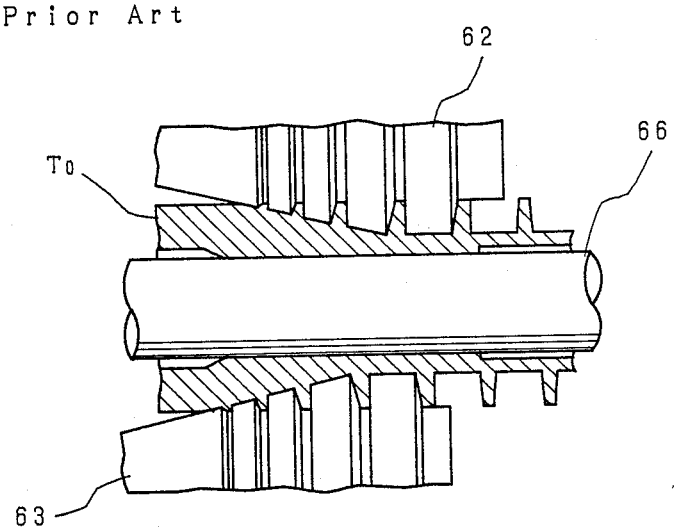
Fig. 5 Prior Art
FIG. 5 is an enlarged sectional view of FIG. 4 taken along the line V—V thereof.
Figure 6:
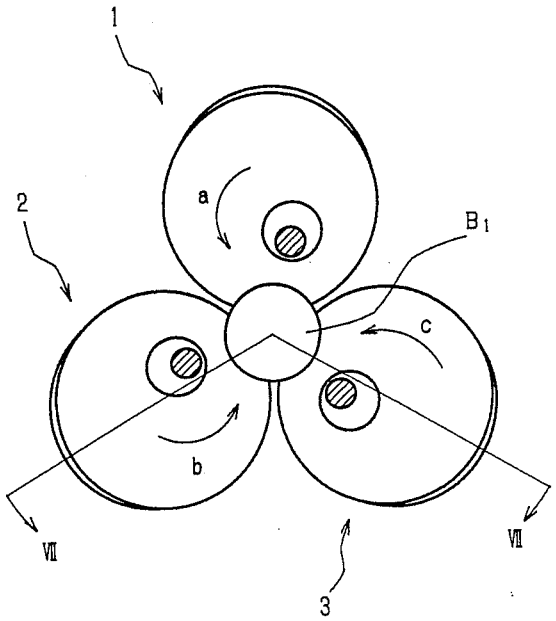
FIG. 6 is a front view showing a first preferred embodiment of the method of manufacturing a metallic tube with spiral fin according to the present invention.
Figure 7:
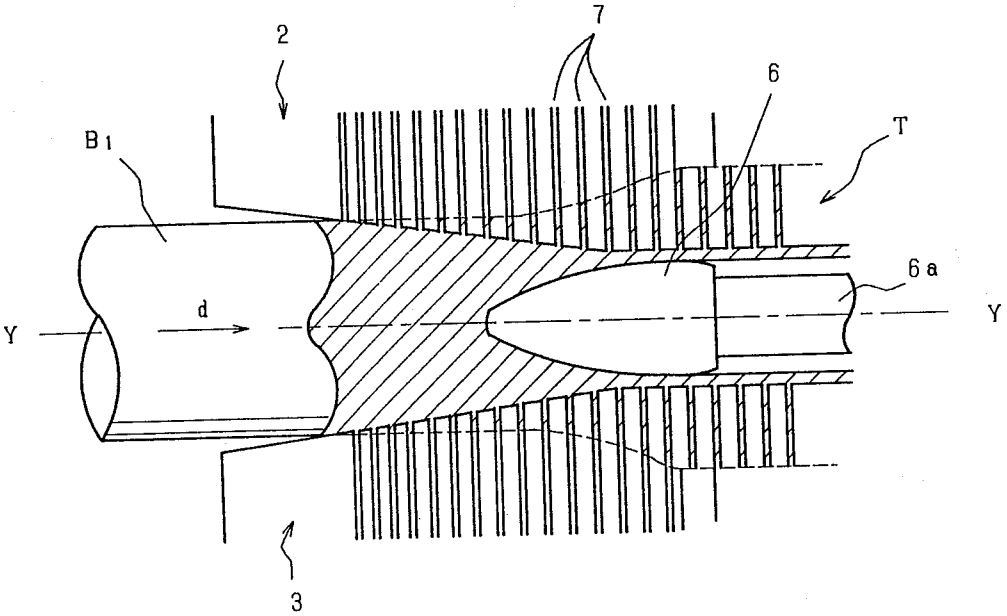
FIG. 7 is an enlarged sectional view of FIG. 6 taken along the line VII—VII thereof.
Figure 8:
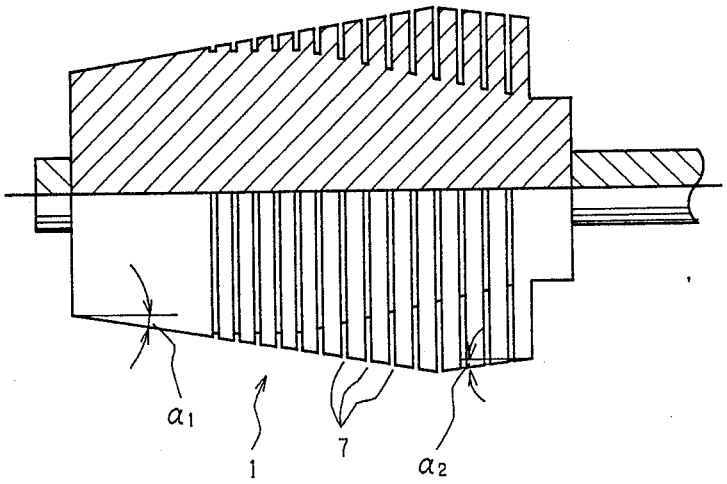
FIG. 8 is a side view showing the roll in FIG. 6 cut in half.

FIG. 6 is a schematic front view showing a state of practicing the first preferred embodiment (the grooves are omitted), FIG. 7 being an enlarged sectional view of FIG. 6 taken along the line VII—VII thereof, and FIG. 8 being a side view showing a roll cut in half. Referring to FIGS. 6, 7, 8, reference numerals 1, 2, 3 designate three rolls disposed at three positions equally divided around the pass line Y—Y and constructing an inclined rolling mill, reference numeral 6 designating a plug, $B_1$ designating a solid metallic bar having a circular cross section, and T designating a metallic tube with a spiral fin. Each roll 1, 2, 3 is supported at both ends thereof and its roll shaft is connected with a driving source (not shown) to rotationally drive the rolls 1, 2, 3 in the same direction (shown by an arrow a, b, c, respectively).

The rolls 1, 2, 3 have the same face angles $\alpha_1$, $\alpha_2$ (refer to FIG. 8) on an inlet side and an outlet side thereof, respectively, axis shaft lines thereof being inclined so that shaft ends on the same side may turn to the same circumferential side (an angle $\beta$ of this axis shaft line relative to the pass line is called an inclined angle) and may approach to or may be separated from the pass line on the same side (an angle $\gamma$ of this axis shaft line relative to the pass line is called a cross angle and the direction where the axis line of the roll is separated from the pass line is defined as being positive).

The rolls 1, 2, 3 are provided with a plurality of annular grooves 7, for example 10 to 20 grooves, cut in a circumferential direction on an outer circumferential surface thereof with suitable intervals in an axial direction, and the formed grooves positions are shifted by 120° in phase between respective rolls. These grooves may be formed on an outer circumference of the integral roll by mechanical working or may be formed by placing disk-like rolls one upon another and supporting them on one piece of shaft to combine them. Between the disk-like rolls the grooves 7, as partially shown in FIG. 7, are different in position, interval, width and depth, respectively, and also in respective rolls, the grooves 7 are different in interval, width and depth toward the material outlet side from the material inlet side.

The position and interval of the grooves 7 and said $\alpha$, $\beta$, $\gamma$ of the inclined roll and the like related thereto are determined depending upon a height and interval of the fin to be formed and a shape of the plug. The position and depth of the grooves 7 are suitably changed toward the material outlet side from the material inlet side taking the spiral flow of metal during the inclined rolling process and the flow of metal in the radial direction of the fin portion formed in the gaps of the grooves of the roll into consideration. In addition, according to the present preferred embodiment, the standing direction of the spiral fin is intended to meet at right angles with an axis of the tube, so that the grooves 7 are formed so that the direction of the grooves 7, that is, the direction of depth of the grooves 7, may meet at right angles with the pass line, matching the cross angle $\gamma$ of the rolls 1, 2, 3.

Thus, the fin coming from one roll is led to the groove of the subsequent roll to be formed in turn. The width and depth of the grooves are nearly the same size between the respective rolls. In addition, the depth of the grooves of the respective rolls 1, 2, 3 is suitably changed from the inlet side to the outlet side so that the desired height of the fin may be obtained at an end of the outlet side.

In addition, the interval and height of the finished fin at the outlet side are dependent upon the last several grooves but if they are identical in interval and depth, the finished size becomes accurate.

The plug 6 is shell-shaped (conical) and its base portion is supported on a pointed end of a mandrel 6*a* and the plug 6 is disposed on the pass line Y—Y of the solid metallic bar $B_1$ and the metallic tube T with spiral fin under the condition that the base surface thereof is nearly at the outlet side of the rolls 1, 2, 3.

The solid metallic bar $B_1$ having a circular section is heated to an appointed temperature (hot rolling temperature) and then supplied to the inclined type piercing rolling mill having said construction from the direction d shown by an arrow and caught among the rolls 1, 2, 3. The solid metallic bar $B_1$ caught among the rolls 1, 2, 3 is transferred in the axial direction while rotating around the axis, that is, the spiral progressive movement is carried out, to lead the fin to the groove of the adjacent roll in turn by the successive rolling processes by means of three rolls. On the other hand, upon inserting the plug 6, a strain component of the material in the radial direction from an inner surface of the material is given to easily flow the metal in the direction of depth of the groove of the roll, whereby the outside diameter of the fin becomes larger than that of the starting material.

It is desired in general that a ratio of the outside diameter of the metallic tube T with spiral fin (the outside diameter of fin) to that of the solid metallic bar $B_1$ (tube expansion ratio) is 1.5 or less in view of the continued stable operation.

In addition, one reason why the above described ratio is selected at 1.5 or less is that if the tube expansion ratio exceeds 1.5, it is necessary to use a large diameter plug and the passing resistance is heightened, whereby the rolling of a terminal end of the bar is not stabilized and the fin is cracked according to the circumstances. Furthermore, in the case where the material is elongated too much in a circumferential direction at the outer circumferential edge of the fin, and likewise if the material being used is poor in workability, problems such as cracking often occur in the circumferential edge portion of the fin.

A second preferred embodiment of the method of manufacturing a metallic tube with spiral fin according to the present invention, in which a solid metallic bar is subjected to piercing rolling using four rolls to manufacture the same metallic tube with spiral fin as that in the first preferred embodiment, is described.

Figure 9:
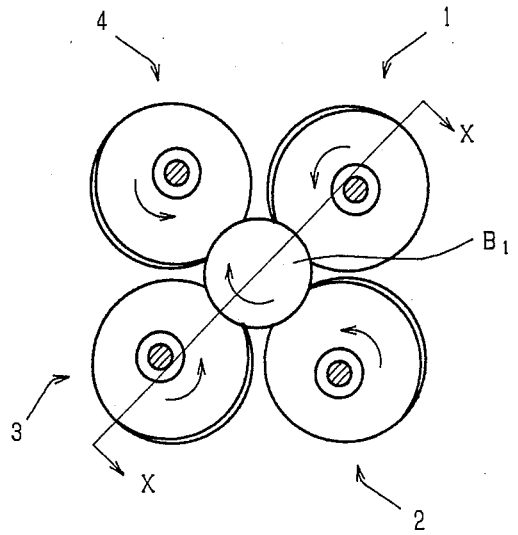
FIG. 9 is a front view showing a second preferred embodiment of the method of manufacturing a metallic tube with spiral fin according to the present invention.
Figure 10:
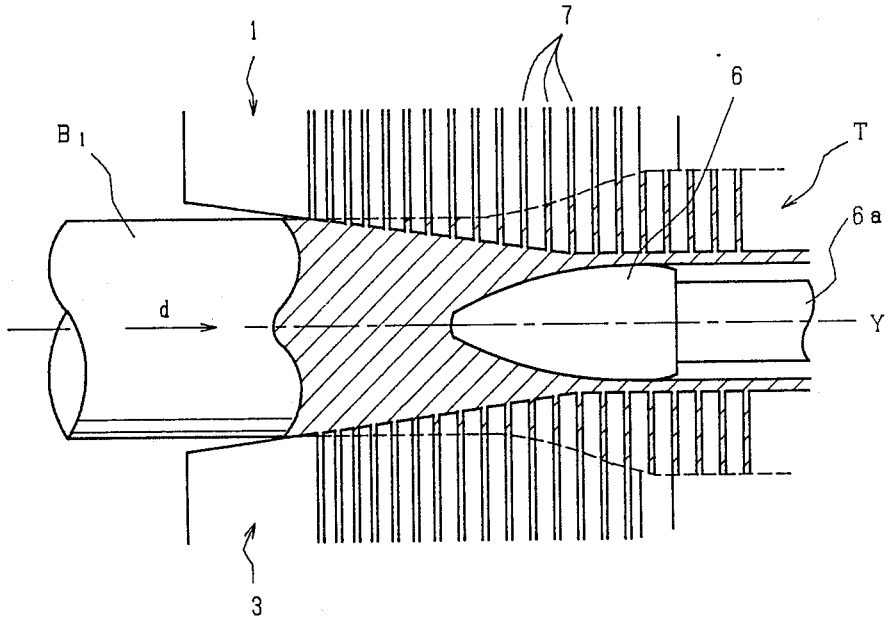
FIG. 10 is an enlarged sectional view of FIG. 9 taken along the line X—X thereof.

FIG. 9 is a schematic front view showing a state of practicing the second preferred embodiment (the grooves are omitted) and FIG. 10 is an enlarged sectional view of FIG. 9 taken along the line X—X thereof. The corresponding members in FIGS. 9 and 10 are marked with the same reference numerals and marks as those used in the first preferred embodiment.

In this preferred embodiment, an inclined rolling mill comprises four rolls 1, 2, 3, 4 disposed, at four positions equally divided around a pass line Y—Y and the respective rolls 1, 2, 3, 4 are provided with annular grooves 7 formed on an outer circumferential surface thereof with shifting by 90° in phase between the respective rolls. The position, interval, width, depth and the like of these grooves 7 are dependent upon the shape of the fin to be formed, the shape of a plug 6 and the flow of metal in the same manner as in said first preferred embodiment.

Also in this second preferred embodiment the heated solid metallic bar $B_1$ is supplied to the inclined rolling mill comprising four rolls and the plug 6 is inserted to be able to manufacture the metallic tube T with spiral fin. In addition, the operation is the same as that in the first preferred embodiment, so that its description is omitted here.

Next, a third preferred embodiment of the method of manufacturing a metallic tube with spiral fin according to the present invention, in which a solid metallic bar is subjected to piercing rolling using two rolls to manufacture the same metallic tube with spiral fin as that in the first preferred embodiment, is described.

Figure 11:
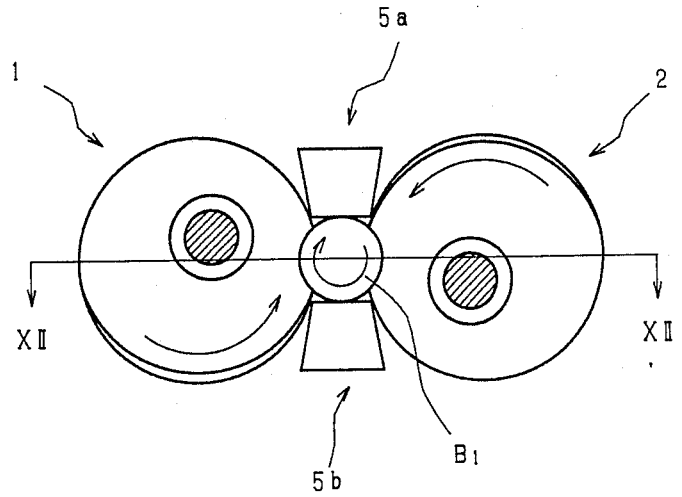
FIG. 11 is a front view showing a third preferred embodiment of the method of manufacturing a metallic tube with spiral fin according to the present invention.
Figure 12:
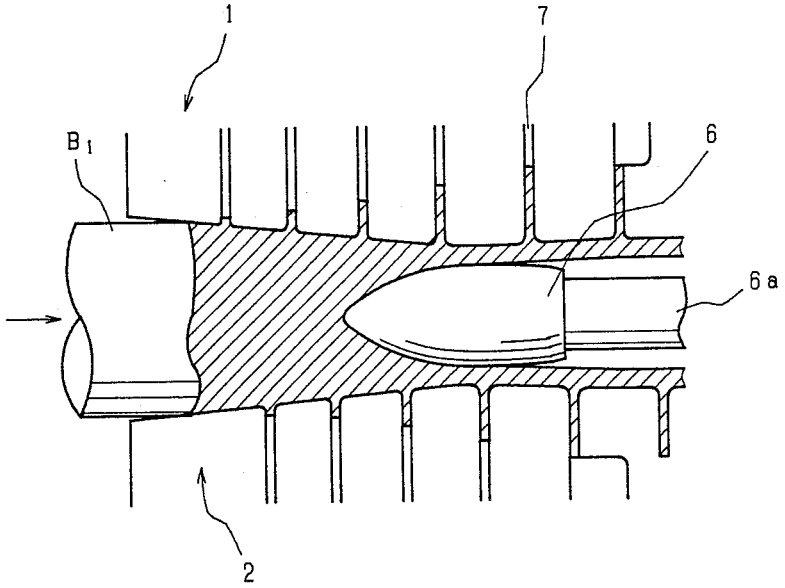
FIG. 12 is an enlarged sectional view of FIG. 11 taken along the line XII—XII thereof.
Figure 13:
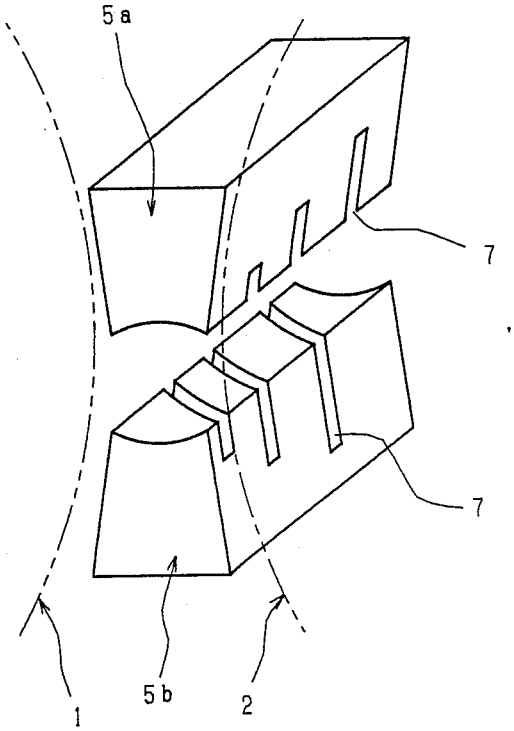
FIG. 13 is a schematic perspective view showing guide shoes shown in FIG. 11.

FIG. 11 is a schematic front view showing a state of practicing the third preferred embodiment (the grooves are omitted), FIG. 12 being an enlarged sectional view of FIG. 11 taken along the line XII—XII thereof, and FIG. 13 being a perspective view showing two guide shoes used in this preferred embodiment. The members in FIGS. 11, 12, 13 are marked with the same reference numerals and marks as those used in the first preferred embodiment.

In the third preferred embodiment the piercing rolling mill comprises two rolls 1, 2 disposed at two positions equally divided around a pass line and guide shoes 5*a*, 5*b* disposed between the rolls 1, 2 in the same manner as in a standard Mannesmann type facility for use in the production of seamless tube. In short, in this preferred embodiment a set of two guide shoes is required which differs from the first and second preferred embodiments in which the number of the rolls is 3 or 4. In this preferred embodiment, grooves 7 are formed on outer circumferential surfaces of two rolls 1, 2 and surfaces of the guide shoes 5*a*, 5*b*.

The respective rolls are provided with the annular grooves 7, the positions of which are shifted by 180° in phase with respect to each roll. On the other hand, the guide shoes are provided with grooves 7 which are formed so as to match the spiral progressive direction of the fin, which is successively formed in the process of rolling the solid metallic bar $B_1$, so that the fin coming out of the preceding roll may enter the groove of the subsequent roll without being destroyed when entering the groove of the adjacent guide shoe.

However, in the case where the inclined rolling mill comprises 5 or more rolls, the diameter of each roll can not be relatively so large-sized as that of an inscribed circle of the rolls, that is, a set-up diameter of the material (in this case, an outside diameter of a bottom between fins of the metallic tube with spiral fin) due to the geometrical condition that the adjacent rolls are brought into contact with each other. In the case where for example the number of the rolls is 5, the diameter of the roll becomes 1.4 or less times the set-up diameter (a diameter of an inscribed circle of 5 rolls) while in the case where the number of the rolls is 6, the diameter of the roll becomes 1.0 or less times the set-up diameter (a diameter of an inscribed circle of 6 rolls), that is, if the number of the rolls is increased, the diameter of the roll can not be increased. Accordingly, the shaft of the roll becomes substantially difficult to be supported at both ends thereof. In addition, since a diameter of the shaft of the roll is small, the rigidity of the shaft of the roll is reduced and the fluctuation of the size due to the fluctuation of temperature of the material is increased. In addition, since a diameter of the roll is small, the rolling speed is reduced, whereby a sufficient productivity can not be attained. On account of the above described reasons, the number of the rolls constructing the inclined rolling mill is limited to 4 or less.

Next, the fourth preferred embodiment of the method of manufacturing a metallic tube with spiral fin according to the present invention, in which a solid metallic bar is subjected to piercing rolling to manufacture a metallic tube with spiral fin, a standing direction of the fin thereof does not meet at right angles with an axis of tube but is inclined by a desired angle relatively to the axis of tube, (screw tube), is described with reference to the case where three rolls are used.

Figure 14:
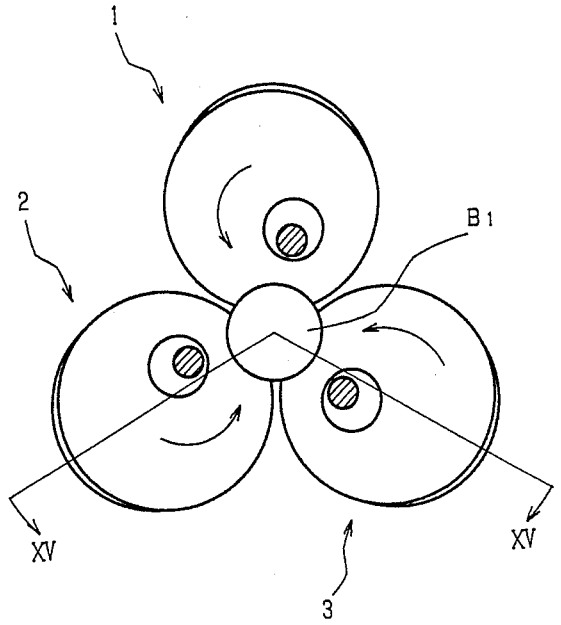
FIG. 14 is a front view showing a fourth preferred embodiment of the method of manufacturing a metallic tube with spiral fin according to the present invention.
Figure 15:
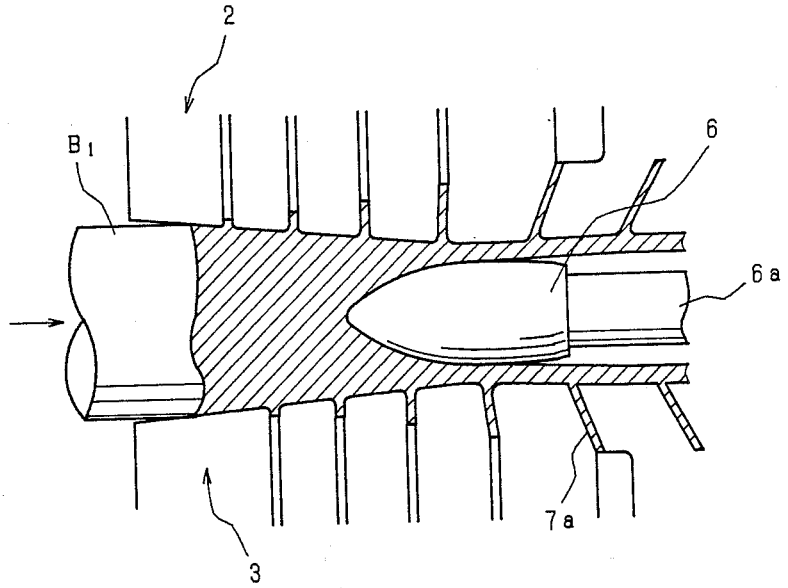
FIG. 15 is an enlarged sectional view of FIG. 14 taken along the line XV—XV thereof.

FIG. 14 is a schematic front view showing a state of practicing the fourth preferred embodiment (the grooves are omitted) and FIG. 15 is an enlarged sectional view of FIG. 14 taken along the line XV—XV thereof. The members in FIGS. 14, 15 are marked with the same reference numerals and marks as used in said first preferred embodiment.

In the fourth preferred embodiment, as shown in FIG. 15, a direction of depth of a groove 7*a* formed on an outlet side of the roll does not meet at right angles with a pass line Y—Y but is inclined relatively to the pass line Y—Y. In addition, the angle between the direction of depth of the groove 7*a* and the pass line is determined on the basis of an inclined angle of the fin of the screw tube to be manufactured and a cross-angle $\gamma$ of the roll. In the case where the solid metallic bar is subjected to the piercing rolling using the rolls provided with such a groove, the formed fin is pushed down by a wall of the inclined groove 7*a* on the outlet side of the roll, so that the screw tube can be manufactured.

Next, the fifth preferred embodiment of the method of manufacturing a metallic tube with spiral fin, in which the solid metallic bar is subjected to piercing rolling to manufacture a metallic tube with a plurality of fins, is described with reference to the case where three rolls are used.

Figure 16A:
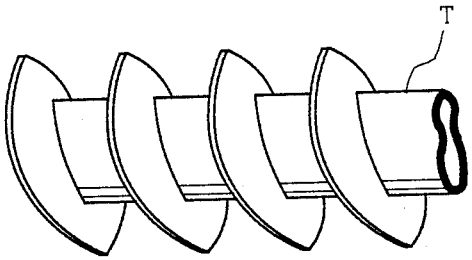
FIGS. 16*a* and 16*b* are perspective views showing a metallic tube with spiral fin.
Figure 16B:
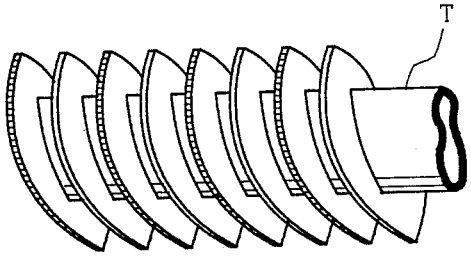

FIG. 16 is a perspective view showing a metallic tube T with spiral fin, FIG. 16(*a*) showing the metallic tube with one fin manufactured by the aforementioned method, and FIG. 16(*b*) showing the metallic tube with two fins manufactured according to the fifth preferred embodiment. In FIG. 16(*b*) the individual fins are shown by hatching and no hatching, respectively.

Also, in the case where a plurality of fins are formed, the formation of the grooves on the rolls are carried out in the same manner as in the formation of a single fin. The grooves are formed on the respective rolls at respective positions of the fins which are shifted by 120° in phase with the material rotation between the respective rolls. In addition, in the case where the number of the rolls is 4, the grooves are formed at respective positions shifted by 90° in phase with the material rotation. Accordingly, the fins are formed in turn in the grooves formed on the rolls without being destroyed. In the case where for example two fins are formed, two lines of fins are formed in parallel relationship at the same time to manufacture a metallic tube with two spiral fins, as shown in FIG. 16(*b*). In addition, in the case where a plurality of fins are formed, the progressive pitch during the rolling becomes 2 times, 3 times, etc., as compared to that in the case where a single fin is used. At this time, the inclined angle $\beta$ of the roll is set at a suitable value in correspondence to the pitch of the spiral fins.

Figure 17:
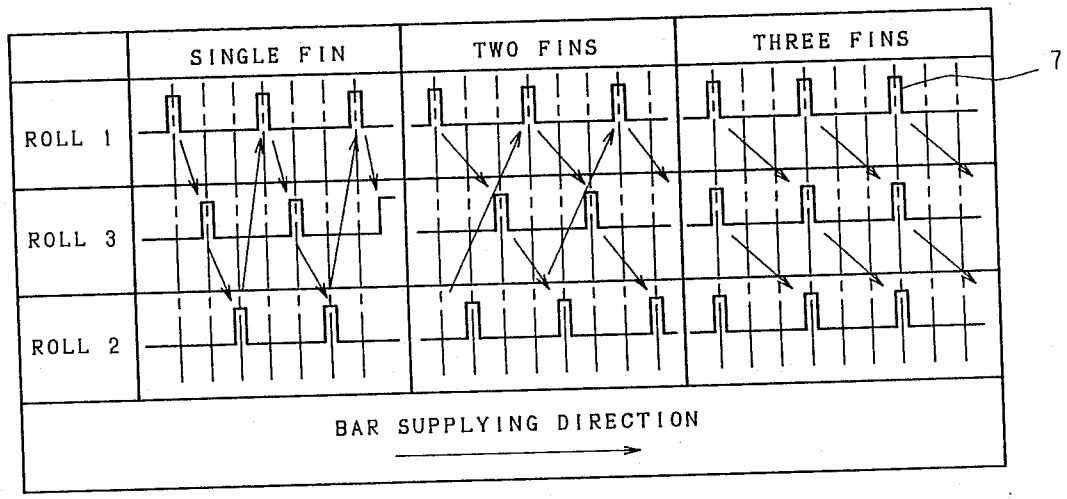
FIG. 17 is a graph showing a state of the formation of the fins for describing a fifth preferred embodiment of the method of manufacturing a metallic tube with spiral fin according to the present invention.

FIG. 17 is a graph showing the design of the roll and the progressive condition of the formation of fins in the case where a single, two or three fins are formed using three rolls. In the case where a single fin is formed, the roll is designed so that the groove of each roll may advance by one pitch for every one rotation of the solid metallic bar while in the case where two or three fins are formed, the roll is designed so that the groove of each roll may advance by two or three pitches respectively for every one rotation of the solid metallic bar. In addition, as understood from FIG. 17, the arrangement of the rolls in the case where two fins are formed is opposite to that in the case where a single fin is formed. In the case where three fins are formed, three rolls are identical in shape.

In this fifth preferred embodiment a plurality of fins can be formed at the same time, so that the production speed can be increased and the productivity can be remarkably improved.

In addition, in the case where a long material is rolled in manufacturing the metallic tube with spiral fin, the temperature of the plug is increased remarkably and the melting loss according to the circumstances increases, but in the fifth preferred embodiment, in which a plurality of fins are formed in parallel at the same time, even though the rotation speed of the roll is the same, the rolling speed can be increased by 2 times, 3 times, etc., so that the rolling time can be reduced to $\frac{1}{2}$, $\frac{1}{3}$, etc. times, thereby reducing the contact time of the plug with the material to be rolled and increasing a useful life time of the plug.

Next, the sixth preferred embodiment of the method of manufacturing a metallic tube with spiral fin according to the present invention, in which three rolls are used and a metallic elementary hollow bar is used as a material to be rolled, is described.

Figure 18:
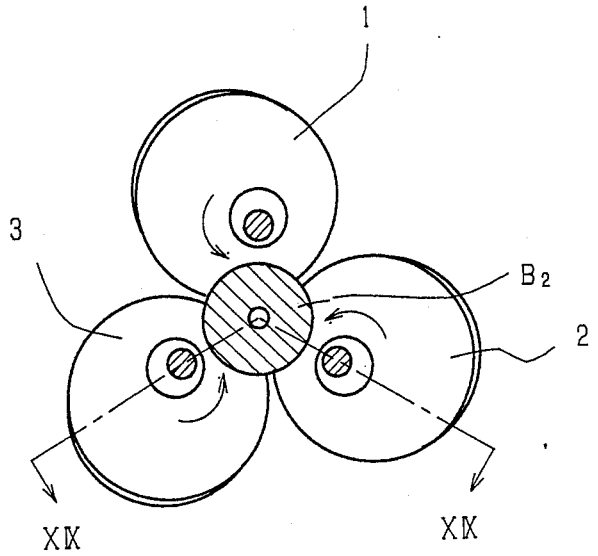
FIG. 18 is a front view showing a sixth preferred embodiment of the method of manufacturing a metallic tube with spiral fin according to the present invention.
Figure 19:
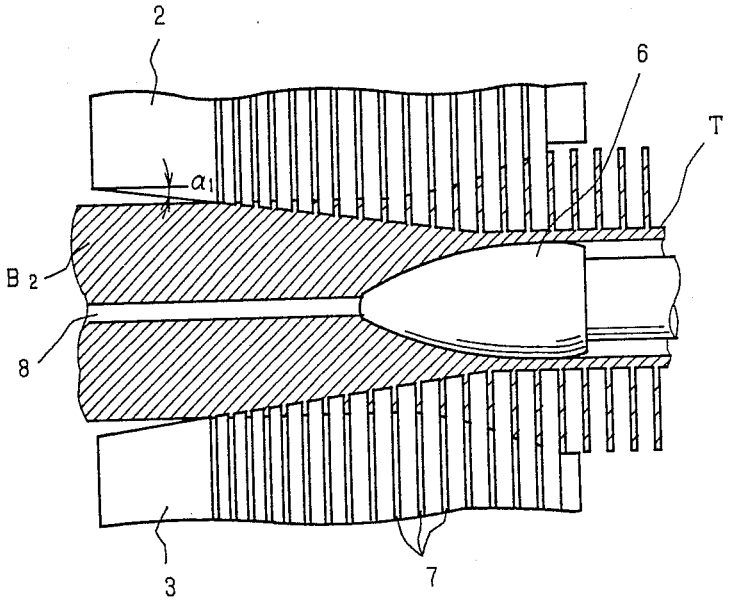
FIG. 19 is an enlarged sectional view of FIG. 18 taken along the line XIX—XIX thereof.

FIG. 18 is a schematic front view showing a state of practicing the sixth preferred embodiment (the grooves are omitted) and FIG. 19 is an enlarged sectional view of FIG. 18 taken along the line XIX—XIX thereof. The members in FIGS. 18, 19 are marked with the same reference numerals and marks as those used in the first preferred embodiment.

Referring to FIGS. 18 and 19, $B_2$ designates a metallic elementary hollow bar, as a material to be rolled, provided with a hole 8 having a small diameter formed at a central portion thereof. In this preferred embodiment this metallic elementary hollow bar $B_2$ is used as the material to be rolled. In addition, the grooves 7 formed on an outer circumferential surface of the rolls 1, 2, 3 are the same as those in the first preferred embodiment.

The metallic elementary hollow bar $B_2$ is heated to a hot rolling temperature (1,200° C. in the case of for example middle carbon steels) in a heating furnace (not shown) and then transferred to an inclined rolling mill, where the metallic elementary hollow bar $B_2$ is subjected to piercing rolling, as shown in FIG. 19. That is to say, when the rolling of the metallic elementary hollow bar $B_2$ by the inclined rolling mill is started, the metallic elementary hollow bar $B_2$ is caught by the rolls 1, 2, 3 in turn and then rolled by them at three positions on the circumference thereof and a diameter of the hole 8 is increased by the plug 6 to carry out the piercing rolling. The material of the metallic elementary hollow bar $B_2$ flows in the radial direction of the metallic elementary hollow bar $B_2$ to be filled in the grooves of the rolls 1, 2, 3, whereby the desired metallic tube T with spiral fin can be obtained from the metallic elementary hollow bar $B_2$.

In this preferred embodiment the diameter of the hole 8 of the metallic elementary hollow bar $B_2$ is selected at values $\frac{1}{2}$ or less times as large as the maximum diameter of the plug 6. The reason for this is that if the diameter of the hole 8 is large, the strain component in the radial direction of the material from an inner surface of the material by the plug 6 is not sufficient to make the flow of metal in the direction of depth of the groove of the roll, whereby a high fin is difficult to form. In this sixth preferred embodiment, the metallic elementary hollow bar is used as the material to be rolled, so that the thermal condition on a pointed end of the plug 6 can be good, whereby tubes, which are formed of materials which are difficult to work such as stainless steel and high-alloyed steel, can be easily manufactured.

In addition, it goes without saying that in the second to fifth preferred embodiments, even though the solid metallic bar as the material to be rolled is replaced by the metallic elementary hollow bar provided with a small hole, the metallic tube with spiral fin can be manufactured in quite the same manner.

Next, the preferred embodiments of the manufacture of the metallic tube with spiral fin by the method according to the present invention is described with reference to the following examples.

EXAMPLE 1

A solid metallic bar (having an outside diameter of 70 mm) formed of S45C (JIS G4051) having a circular section, which was obtained by hot rolling, was subjected to rolling using an inclined rolling mill having three rolls provided with a plurality of grooves formed on a circumference thereof to manufacture a metallic tube with spiral fin having the following parameters (the first preferred embodiment):

| | |
|---|---|
| Fin interval: | 10 mm |
| Outside diameter of fin: | 84 mm |
| Diameter of a bottom fin: | 54 mm |
| Inside diameter: | 40 mm |

The operating conditions of the inclined rolling mill (rolls) at this time are as follows:

| Dimensional parameters of the inclined rolling mill | |
|---|---|
| Material of rolls: | SCM440 (JIS G4105) |
| Inclined angle $\beta$ of rolls: | 4° |
| Cross angle $\gamma$ of rolls: | 0° |
| Diameter of the largest portion of rolls: | 220 mm |
| Face angle at an inlet of rolls $\alpha_1$: | 7° |
| Face angle at an outlet of rolls $\alpha_2$: | 1° |
| Rolling speed: (in the axial direction of tube on the outlet side) | 0.16 m/sec |
| Rotation speed of rolls: | 200 rpm |

As a result, superior metallic tube with spiral fin was obtained.

EXAMPLE 2

A metallic tube with two fins was manufactured (the fifth preferred embodiment) by the same pass schedule as in Example 1. In addition, an inclined angle $\beta$ was selected at 8° which was 2 times as large as that in Example 1. Other conditions are as follows:

| | |
|---|---|
| Cross angle $\gamma$ of rolls: | 0° |
| Rotation speed of rolls: | 200 rpm |
| Rolling temperature: | 1,200° C. |
| Rolling speed: (in the axial direction of tube on the outlet side) | 0.32 m/sec |

As a result, the rolling speed could be increased by 2 times as large as that in Example 1.

EXAMPLE 3

The cross angle $\gamma$ of rolls was selected at 1° and other conditions were selected at the same values as those in Example 1 to manufacture a metallic tube with spiral fin. An angle of the groove relative to a shaft of the roll was set so as to meet at right angles with a pass line.

In addition, it was confirmed that also in the case where the cross angle $\gamma$ was set at a negative value, a similar method could be applied.

EXAMPLE 4

A solid metallic bar (having an outside diameter of 70 mm) formed of SCM435 (JIS G4105) having a circular section, which was obtained by hot rolling, was subjected to rolling using an inclined rolling mill having three rolls provided with a plurality of grooves formed on a circumference thereof to manufacture a screw tube having the following parameters (the fourth preferred embodiment):

| | |
|---|---|
| Fin interval: | 50 mm |
| Outside diameter of fin: | 90 mm |
| Diameter of a bottom fin: | 50 mm |

-continued

| | |
|---|---|
| Inside diameter: | 36 mm |

In addition, a standing angle of the fin was selected at 60° relative to an axis of tube (in short, under the condition that the vertical fin was inclined by 30°) and the operating conditions of the inclined rolling mill (rolls) at this time were as follows:

| Dimensional parameters of the inclined rolling mill | |
|---|---|
| Material of rolls: | SKD61 (JIS G4404) |
| Inclined angle $\beta$ of rolls: | 16° |
| Cross angle $\gamma$ of rolls: | 2° |
| Diameter of the largest portion of rolls: | 200 mm |
| Face angle at an inlet of rolls $\alpha_1$: | 3° |
| Face angle at an outlet of rolls $\alpha_2$: | 2° |
| Inclined angle of the groove of rolls at an outlet side end: | 30° |

As a result, a superior screw tube was obtained.

EXAMPLE 5

The same screw tube as in Example 4 was manufacture using an inclined rolling mill provided with two rolls (the third preferred embodiment + the fourth preferred embodiment). The operating conditions of the inclined rolling mill (rolls) at this time are as follows:

| Dimensional parameters of the inclined rolling mill | |
|---|---|
| Material of rolls: | SCM440 (JIS G4105) |
| Inclined angle $\beta$ of rolls: | 16° |
| Cross angle $\gamma$ of rolls: | 2° |
| Diameter of the largest portion of rolls: | 550 mm |
| Face angle at an inlet of rolls $\alpha_1$: | 3.5° |
| Face angle at an outlet of rolls $\alpha_2$: | 3.5° |
| Guide shoe: | plate guide shoe with grooves |

As a result, the same screw tube as in Example 4 could be manufactured.

In the case of two rolls, since the diameter of the rolls is not geometrically restricted, the diameter of the rolls can be increased (200 mm→500 mm), thereby increasing the rolling speed. Accordingly, in the case where a metallic tube with a spiral fin having a relatively long pitch is manufactured as in this Example 5, the tube material can be easily held by the guide shoes, so that this highly efficient method of using two rolls (the third preferred embodiment) is suitable. On the other hand, in the case where a metallic tube with a spiral fin having a relatively short pitch is manufactured as in Example 1, the method of using three or four rolls without requiring guide shoes (the first or second preferred embodiment) is suitable.

EXAMPLE 6

A screw tube having the following parameters was manufactured using an inclined rolling mill having three rolls from a metallic elementary hollow bar formed of STBA24 (JIS G3462) having an outside diameter of 65 mm and an inside diameter of 10 mm (in other words, provided with a hole having a diameter of 10 mm at a central portion thereof) (the sixth preferred embodiment).

| | |
|---|---|
| Fin interval: | 7 mm |
| Outside diameter of fin: | 75 mm |
| Diameter of a bottom fin: | 38 mm |
| Inside diameter: | 31 mm |

In addition, the operating conditions of the inclined rolling mill (rolls) at this time are as follows:

| Dimensional parameters of the inclined rolling mill | |
|---|---|
| Material of rolls: | SCM440 (JIS G4105) |
| Inclined angle $\beta$ of rolls: | 3.5° |
| Cross angle $\gamma$ of rolls: | 0° |
| Diameter of the largest portion of rolls: | 190 mm |
| Face angle at an inlet of rolls $\alpha_1$: | 5° |
| Face angle at an outlet of rolls $\alpha_2$: | 2° |
| Rotation speed of rolls: | 200 rpm |
| Rolling temperature: | 1,150° C. |
| Rolling speed: (in the axial direction of tube) | about 0.1 m/sec |

As a result, a high fin tube, which has been difficult to manufacture by plastic working or by the plate winding welding method, could be easily manufactured as an integral product.

In addition, although the cross angle $\gamma$ of the rolls was set at 0° in the above described Example, the cross angle of the rolls is not limited to this but can be set at either a positive value or a negative value depending upon the specification and construction of the rolling mill. Incidentally, provided that the cross angle $\gamma$ of the rolls is 1°, the face angle $\alpha_1$ on an inlet side of the rolls being 6°, and the face angle $\alpha_2$ on an outlet side of the rolls being 1°, an angle of a pressing face of the roll relative to a pass line becomes 5° on the inlet side and 2° on the outlet side in the same manner as in the above described Example, thereby obtaining a high fin tube equivalent to the high fin tube obtained in the above described Example. However, the angle of the groove of the roll was inclined by 1° toward the inlet side so as to meet at right angles with an axis of the metallic elementary hollow bar under the condition that the cross angle of the roll is 1°.

As this invention may be embodied in several forms without departing from the scope thereof, the present embodiments are therefore illustrative and not restrictive, since the scope of the invention is defined by the appended claims rather than by the description preceding them, and all changes that fall within the meets and bounds of the claims, or equivalents of such meets and bounds thereof are therefore intended to be embraced by the claims.

What is claimed is:

1. A method of manufacturing a finned metallic tube comprising:

supplying a solid metallic bar to an inclined rolling mill having a plurality of rotating rolls disposed around a pass line and provided with a plurality of annular grooves formed in a circumferential direction of an outer circumferential surface thereof;

rolling said solid metallic bar by said rolls; and working said solid metallic bar into a pierced hollow bar by a piercing plug, and at the same time introducing material of said solid metallic bar into said grooves to form at least one fin at the outer circumferential surface of the pierced hollow bar.

2. A method of manufacturing a finned metallic tube as set forth in claim 1, in which the number of said plurality of rolls is 3 or 4.

3. A method of manufacturing a finned metallic tube as set forth in claim 2, in which the respective rolls are rotated, so that the grooves of the respective rolls may advance by one pitch during one rotation of said solid metallic bar, to form a single continuous fin.

4. A method of manufacturing a finned metallic tube as set forth in claim 2, in which the respective rolls are rotated, so that the grooves of the respective rolls may advance by a plurality of pitches during one rotation of said solid metallic bar, to form a plurality of continuous fins.

5. A method of manufacturing a finned metallic tube as set forth in claim 2, in which the fin is formed so as to extend substantially perpendicular to an axis of tube by using the rolls provided with the grooves, whose direction of depth is substantially perpendicular to the pass line.

6. A method of manufacturing a finned metallic tube as set forth in claim 2, in which the fin is formed by inclining the material of said solid metallic bar in the supplying direction of said solid metallic bar by using the rolls provided with the grooves, the grooves formed on an outlet side of the rolls having a direction of depth which is inclined closer to an outlet side than a direction perpendicular to the pass line.

7. A method of manufacturing a finned metallic tube as set forth in claim 6, wherein said fin is inclined radially outwardly from a root thereof.

8. A method of manufacturing a finned metallic tube as set forth in claim 1, in which said plurality of rolls comprise two in number and said inclined rolling mill is provided with two guide shoes, which are disposed between said two rolls, respectively, and provided with grooves formed on a surface thereof corresponding to respective positions of the grooves of the rolls.

9. A method of manufacturing a finned metallic tube as set forth in claim 8, in which the respective rolls are rotated, so that the grooves of the respective rolls and guide shoes may advance by one pitch during one rotation of said solid metallic bar, to form a single fin.

10. A method of manufacturing a finned metallic tube as set forth in claim 8, in which the respective rolls are rotated, so that the grooves of the respective rolls and guide shoes may advance by a plurality of pitches during one rotation of said solid metallic bar, to form a plurality of continuous fins.

11. A method of manufacturing a finned metallic tube as set forth in claim 8, in which the fin is formed so as to extend substantially perpendicular to an axis of said tube by using the rolls and guide shoes provided with the grooves, whose direction of depth is substantially perpendicular to the pass line.

12. A method of manufacturing a finned metallic tube as set forth in claim 8, in which the fin is formed by inclining the material of said pierced hollow bar in the supplying direction of said solid metallic bar by using the rolls and guide shoes provided with the grooves, the grooves formed on an outlet side of the rolls and the guide shoes having a direction of depth which is inclined closer to an outlet side than a direction perpendicular to the pass line.

13. A method of manufacturing a finned metallic tube as set forth in claim 1, wherein said piercing plug includes a free end thereof engaged with said solid metallic bar so as to form said hollow bar, said solid metallic bar moving axially in a feed direction relative to said piercing plug, said free end of said piercing plug facing a direction opposite to said feed direction.

* * * * *